United States Patent [19]

Cramer et al.

[11] Patent Number: 4,514,343

[45] Date of Patent: Apr. 30, 1985

[54] ASPIRATING HORIZONTAL MIXER

[75] Inventors: Barry G. Cramer; Roy A. Cramer, both of Kansas City, Mo.

[73] Assignee: Air-O-Lator Corporation, Kansas City, Mo.

[21] Appl. No.: 428,098

[22] Filed: Sep. 29, 1982

[51] Int. Cl.[3] ..... B01F 3/04

[52] U.S. Cl. ..... 261/37; 210/221.2; 210/242.2; 261/76; 261/93; 261/120; 261/123; 261/DIG. 75; 441/22

[58] Field of Search ..... 261/37, 76, 92, 93, 261/120, 123, 124, DIG. 75, 91; 210/242.2, 242.1, 219, 221.2; 209/169, 170; 441/21, 22, 37, 133

[56] References Cited

U.S. PATENT DOCUMENTS

| | | | |
|---|---|---|---|
| 2,414,260 | 1/1947 | Hunter | 261/DIG. 75 |
| 3,322,410 | 5/1967 | Ahlenius | 261/92 |
| 3,365,178 | 1/1968 | Bood | 261/DIG. 75 |
| 3,561,738 | 2/1971 | Galeano | 261/92 |
| 3,589,997 | 6/1971 | Grutsch et al. | 261/120 X |
| 3,595,537 | 7/1971 | Kaelin | 261/120 X |
| 3,595,538 | 7/1971 | Baumann | 261/120 X |
| 3,664,647 | 5/1972 | Snow et al. | 261/120 X |
| 3,675,779 | 7/1972 | Grutsch et al. | 210/242.2 |
| 3,719,353 | 3/1973 | Cherne et al. | 210/242.2 |
| 3,755,142 | 8/1973 | Whipple, Jr. | 261/124 X |
| 3,759,495 | 9/1973 | Boler et al. | 261/120 X |
| 4,046,691 | 9/1977 | Irons | 210/242.1 X |
| 4,140,737 | 2/1979 | Hauser | 210/242.2 X |
| 4,190,619 | 2/1980 | Cherne | 261/120 X |
| 4,191,479 | 3/1980 | Shuck et al. | 261/120 X |
| 4,210,613 | 7/1980 | Webb | 261/123 X |
| 4,287,060 | 9/1981 | Coggins | 210/242.2 X |
| 4,350,589 | 9/1982 | Stog | 261/120 X |
| 4,350,648 | 9/1982 | Watkins et al. | 261/120 |
| 4,409,100 | 10/1983 | Rajendren | 261/DIG. 75 |

*Primary Examiner*—Richard L. Chiesa

*Attorney, Agent, or Firm*—Litman, Day & McMahon

[57] ABSTRACT

An aspirating horizontal mixer for aerating and liquid mixing includes a float with tiltable supports extending downwardly into a body of water and an air delivery conduit which are connected to a mixer unit supported below the liquid surface by the supports and tiltable therewith. The mixer unit includes a submersible motor powering a propeller and a nozzle member situated in the flow path of liquid from the propeller. The nozzle member has an internal venturi for mixing air from the air delivery conduit with the liquid flowing therethrough and includes a converging wall formation forming a constriction and a diverging wall formation leading downstream and merging with the interior wall of the nozzle member. An air injection port extends through the diverging wall formation adjacent the constriction and is in communication with the air delivery conduit for mixing air with the liquid as it flows through the venturi.

5 Claims, 7 Drawing Figures

ASPIRATING HORIZONTAL MIXER

This invention relates to mixers for stirring water in lagoons, ponds and the like and in particular, to a liquid mixer providing an aeration function.

BACKGROUND OF THE INVENTION

In the mixing and aeration of large bodies of liquid, several different types of mixers have been used, such as floats and pumps. Generally, the flotation types have heretofore been insufficiently controllable in most directions of flow for efficient mixing. Further, most aeration apparatuses used in combination with mixers require various compressors supplying a source of air to the mixer wherein the compressed air is injected into the liquid medium through nozzles and the like. The compressors generally expend great amounts of energy and increase the total cost of operation of the system.

In other applications, pumps and the like have been used, but these often do not provide sufficient rates of flow for the efficient mixing required in the equalization basins, as well as oxidation ditches, sludge holding tanks and other special applications. Mixers are also used in aerated lagoons in which biological solids are in equilibrium within applied waste. The basin is of sufficient depth, normally six to twelve feet and oxygen is furnished by mechanical aeration to create a turbulence level sufficient to provide adequate liquid mixing. As a result of the mixing, uniform distribution of the waste and dispersion of the oxygen is achieved to promote efficient waste biodegration. Moreover, previous mixing and air injecting appratuses have tended to be overly expensive, somewhat inefficient, too heavy and in some instances unreliable.

In view of the above, the present aspirating horizontal mixer has been particularly directed to low cost manufacture, efficient operation, reliablility in use and is light weight for one or two man handling. The present mixer is of a design permitting total oxygen dispersion throughout an entire basin at low power levels generally not attainable in the past by the use of prior art devices. Moreover, the present mixer can be used in conjunction with existing surface and subsurface aeration and mixing devices.

OBJECTS OF THE INVENTION

The principal objects of the present invention are: to provide a mixing aerator having a sturdy, sealed motor assembly for submersion within a body of liquid; to provide such an aspirating horizontal mixer having a flotation means which suspends a mixer unit below the upper surface of liquid in a body; to provide such a mixer having support means connecting the flotation members to the mixer unit and which can be adjusted vertically to almost any depth normally required and may be inclined so that the flow of air and water is either up, down, or horizontal; to provide such a mixer having a surface aeration function if the mixer unit is inclined upwardly and the outlet end of the mixer unit is adjusted to a position close to the surface; to provide such a mixer in which critical parts, such as a propeller and a motor are easily accessible for ease of replacement and repair in the field; to provide such a mixer in which almost all of the pumping energy for the propeller is converted to store axial flow for efficient exit flow throughout the body of liquid, resulting in superior mixing and contact interface with the liquid body; to provide such a mixer having free access to the propeller thereby preventing jamming due to interference of solid particles between the propeller and any shroud or intake volute; to provide such a mixer which is energy efficient and has a substantial portion of the energy consumed transmitted to the liquid; to provide such a mixer having relatively small dimensions, and which is light in weight and simple to install.

Other objects and advantages of this invention will become apparent from the following description taken in conjunction with the accompanying drawings wherein are set forth, by way of illustration and example, certain embodiments of this invention.

DESCRIPTION OF THE PREFERRED EMBODIMENT

Figure 2:
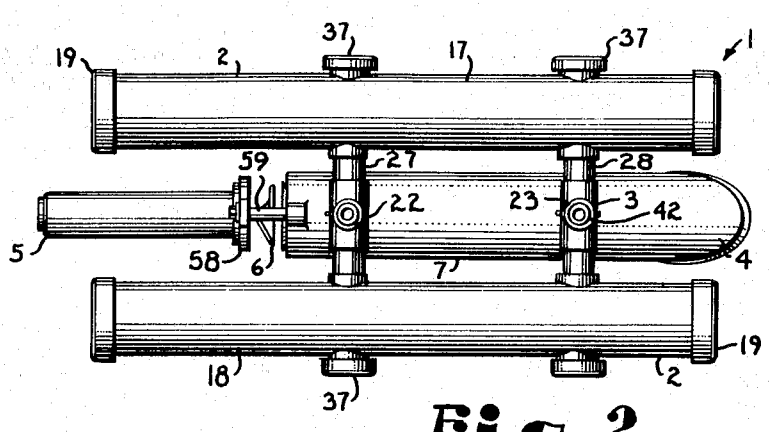
FIG. 2 is a plan view of the aspirating horizontal mixer.
Figure 1:
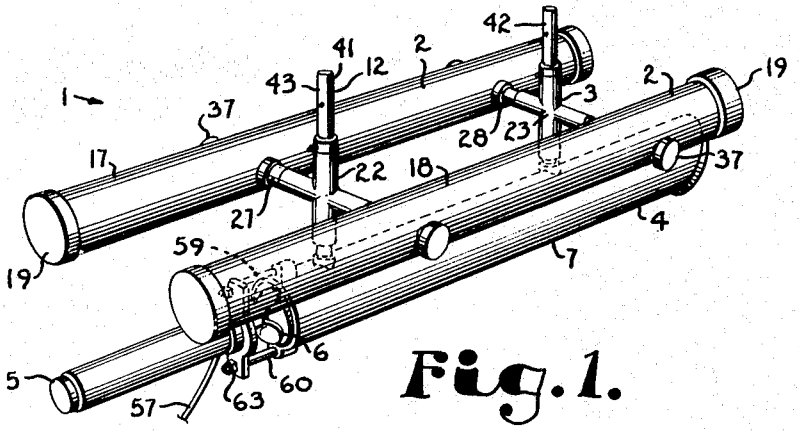
FIG. 1 is perspective view of an aspirating horizontal mixer embodying the present invention.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 3:
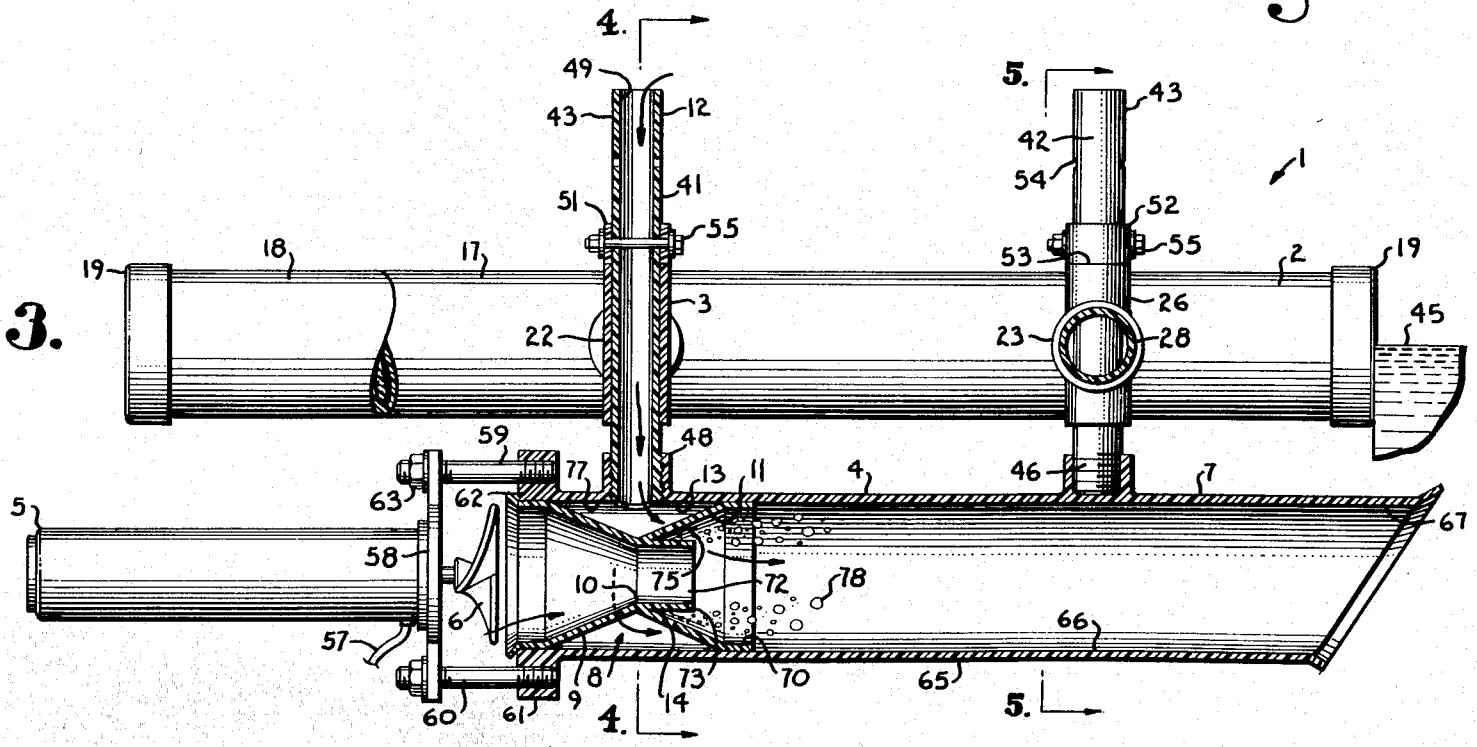
FIG. 3 is an enlarged, fragmentary, side elevational view of the aspirating horizontal mixer.

Referring to the drawings in more detail:

The reference numeral 1 generally indicates an aspirating horizontal mixer embodying the present invention. In overview, the mixer 1 includes an upper flotation means 2 connected to a support means 3 which is adjustable and tiltable to vary the positioning of a mixer unit 4 affixed to lower ends of the support means 3. The mixer unit 4 includes a submersible motor 5 powering a propeller 6 and having an elongate nozzle member 7 situated in the flow path of the liquid from the propeller 6. The nozzle member 7 has an internal converging wall formation 8, FIG. 3, forming a constriction 9 situated generally adjacent the inlet end and a diverging wall formation 10 leading downstream therefrom and merging with the interior walls of the nozzle member 7.

An air delivery conduit 11 and a manifold means 12 for routing air to the venturi means 8 includes a port 14 situated immediately following the constriction 10, whereby the flow of fluid through the venturi means 8 draws air through the delivery conduit 12 for efficient mixing with the liquid.

In the illustrated example, the flotation means 2 includes spaced, parallel floats 17 and 18 of cylindrical, hollow configuration having opposite end caps 19 closing the floats 17 and 18 and interior areas filled with a synthetic plastic foam material for flotation even if the outer skin of the float 17 or 18 becomes punctured.

Figure 4:
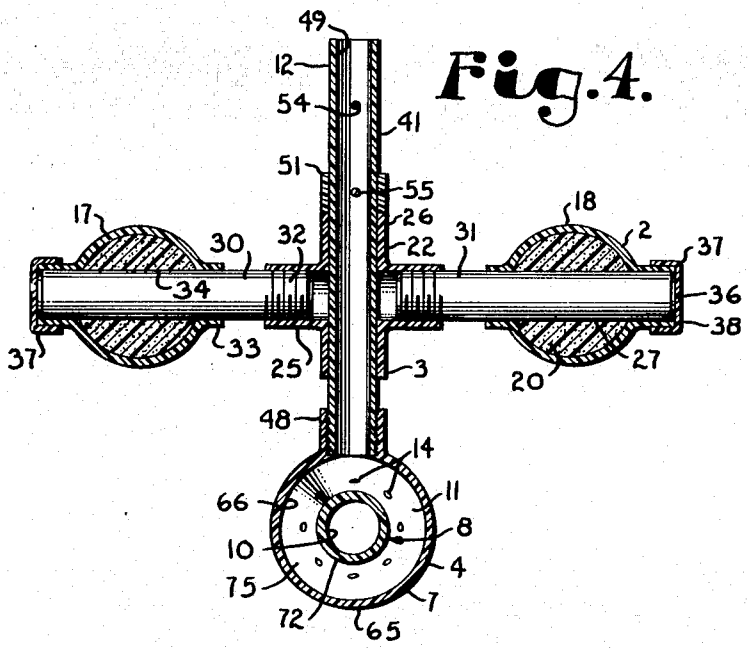
FIG. 4 is a transverse, sectional view of the mixer taken along lines 4—4, FIG. 3.
Figure 5:
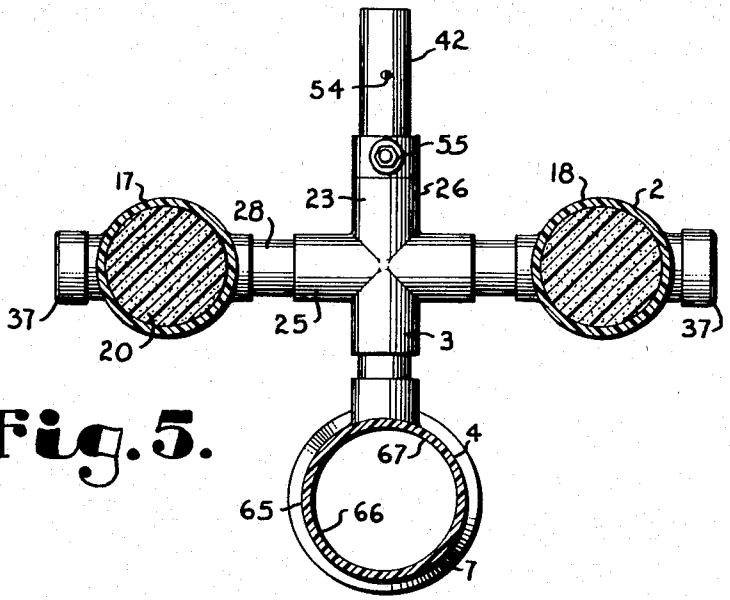
FIG. 5 is a transverse sectional view of the mixer taken along lines 5—5, FIG. 3.

The exemplary support means 3 are in the form of tubular cross members 22 and 23 having perpendicular arm portions comprising a horizontal portion 25 and a substantially vertical portion 26, FIGS. 4 and 5. Spaced, parallel connector tubes 27 and 28 extend through and between the floats 17 and 18 and are rotatable therein. In the illustrated example, the connector tubes 27 and 28 each comprise colinearly aligned half sections 30 and 31, FIG. 4. Inner threaded ends 32 are threadably received in the horizontal portions 25 of the respective connector tubes 27 or 28 and extend outwardly thereof and through the respective floats 17 or 18. The floats 17 and 18 respectively include spaced bushings 33 aligned with a through bore 34 and extending transversely across the float 17 or 18. The half sections 30 and 31 extend through the bore 34 and bushings 33 and have outer end portions 36 secured, as by gluing to end caps 37. The end caps 37 abut the outer shoulders 38 of the outer bushing 33 and permit relative rotation therebetween whereby the connector tubes 27 and 28 may rotate relative to the floats 17 and 18, thereby permitting tilting of the cross member vertical portions 26.

First and second support tubes 41 and 42 are respectively telescopically received in the vertical portions 26 of the first and second cross members 22 and 23. Each of the support tubes 41 and 42 is sufficiently elongate so that the mixer unit 4 may be suspended below the floats 17 and 18 a desired distance. The support tubes 41 and 42 have upper ends 43, FIG. 3 which preferably extend upwardly above a top surface of a body of fluid 45, and lower ends 46 which are connected to the nozzle member 7 in order to support the mixer unit 4. In the illustrated example, the nozzle member 7 has walls defining spaced receptacles 48 which are threaded on the interior thereof and the support tube lower ends 46 are also threaded whereby the lower ends 46 are threadably received in the receptacles 48. As described more fully below, the first support tube 41 also comprises the air delivery conduit 12 and has a hollow interior 49 for flow of air therethrough. The second support tube 42 merely bottoms out in the receptacle 48 on the nozzle member 7, FIG. 3.

Lock means 51 respectively affix the support tubes 41 and 42 to the vertical portions 26 of the respective cross members 22 and 23 and are adjustable to vary the telescopic extension and retraction of the support tubes whereby both the depth and upward or downward tilt of the mixer unit 4 can be selected as desired. In the illustrated example, the lock means 51 include a collar 52 which extends about the support tube 41 or 42 and abuts the upper cross member vertical portion 26. A plurality of aligned holes 54 extend through the connector tubes 27 and 28 and a bolt 55 extends through the collar 52 and through selected holes 54. To adjust the height setting of the connector tubes 27 or 28 through the vertical portion 26, the bolts 55 are loosened and removed and the connecting tubes 27 or 28 slid upwardly or downwardly until the desired setting is reached and the bolts 55 are reinserted through a desired pair of the series of holes 54.

The mixer unit 4 is suspended generally below and between the floats 17 and 18 and includes the submersible motor 5 powering the propeller 6 and the nozzle member 7 situated in the flow path of the liquid from the propeller 6. The motor 5 is submersible and is an electric motor, such as manufactured by Franklin. Preferably, the motor is liquid cooled and lubricated, of stainless steel construction and rated for moderate chemical duty operation. Electrical power is supplied through a power line 57. The motor 5 is affixed to a motor mount 58 having upper and lower spaced posts 59 and 60 extending outwardly from the mount 58 and connected to ears 61 on an inlet end 62 of the nozzle member 7. The posts 59 and 60 support the nozzle member 7 as later described and are spaced from the propeller 6 a suitable distance which will allow solid objects to pass between the propeller 6 and the posts 59 and 60. End portions of the posts 59 and 60 are threaded to receive suitable nuts 63.

The propeller 6 is preferably a hard chromed member designed for the specific function of effecting outward flow of the liquid toward and into the nozzle member 7. It is preferred that a bearing for the propeller 6 be completely independent of the motor bearings. The propeller 6 has a shaft (not shown) which is received in a journal which is preferably hard chromed and bourne by a liquid lubricated cutlass type bearing capable of absorbing substantially all radial and shock loads, thereby protecting the motor bearings.

The nozzle member 7 is mounted on the posts 59 and 60 and is positioned in longitudinal axial alignment with the propeller 6.

The nozzle member 7 is of substantially cylindrical shape and is hollow with wall means 65 defining an internal surface 66 extending longitudinally therethrough and communicating between an inlet end 62 and an outlet end 67, which may be flared as shown. The venturi means 8 is situated adjacent the inlet end 62 and mixes air from the air delivery conduit 12 with liquid flowing through the nozzle member 7.

The venturi means 8 includes the converging wall formation 9 forming the constriction 10 and the diverging wall formation 11 leading downstream therefrom and merging with the internal surface 66 of the wall means 65. Preferably, both the converging and diverging wall formations 9 and 11 are frusto-conical in configuration and joined together, as by welding, at respective narrow ends so as to form the constriction 10. Each of the converging and diverging wall formations 9 and 11 include opposite flanges 70 forming a lip secured to the wall internal surface 66 as by welding. Preferably, a relatively short tubular member or extension 72 commences at and extends downstream from the constriction 10 and terminates at an end 73 in spaced relationship to the mid portion of the diverging wall formation 11 so as to form a low pressure area 75 thereat.

In the illustrated example, the air delivery manifold means 13 is formed by the association of the converging and diverging wall formations 9 and 11 with the wall internal surface 66. As stated heretofore, the wall formations 9 and 11 are positioned in abutment and secured within the nozzle member inlet end 62, thereby forming a space 77 comprising the manifold means 13. A plurality of the air injection ports 14 extend through the diverging wall formation 11 in the low pressure area 75 and communicate with the manifold means 13 whereby flow of the liquid through the venturi means 8 tends to draw air through the delivery conduit 12, manifold means 13 and ports 14 for injection into and mixing with the liquid. Preferably, the suction in the low pressure area is sufficient to draw air from the external atmosphere downwardly through the air delivery conduit 12 and into the nozzle member 7. The length of the conduit 12 down which air will be drawn is of course dependent upon the propeller shape, the power rating of the motor 5 and the configuration of the converging and diverging wall formations 9 and 11; however, actual operation has indicated a delivery conduit 12 of several feet in length is practical and operable. For greater depths and where the mixer unit 4 may not be supported by the flotation means 2, it may be necessary to provide an air compressor and hose which would then supply compressed air or gas into the manifold means 13 from a relatively far distance. As used in the illustrated example, no compressor or other source of compressed gas to force air into the nozzle member 7 is necessary as the low pressure created by the venturi means 8 is wholly sufficient to draw air and cause a stream of air bubbles to be sustantially flash mixed with liquid flowing through the nozzle member 7.

The remainder of the nozzle member 7 beyond the venturi means 8 is substantially smooth to facilitate rapid, non-turbulent flow of the mixed stream of air and liquid until reaching the outlet end 67. Preferably, the outlet end 67 is angled so that the greater opening points gently downwardly.

Figure 6:
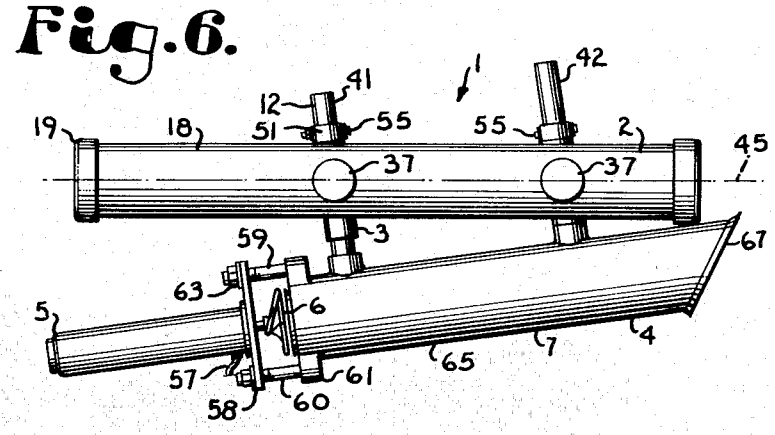
FIG. 6 is a side elevational view of the mixer showing adjustment into an upwardly tilted relationship.
Figure 7:
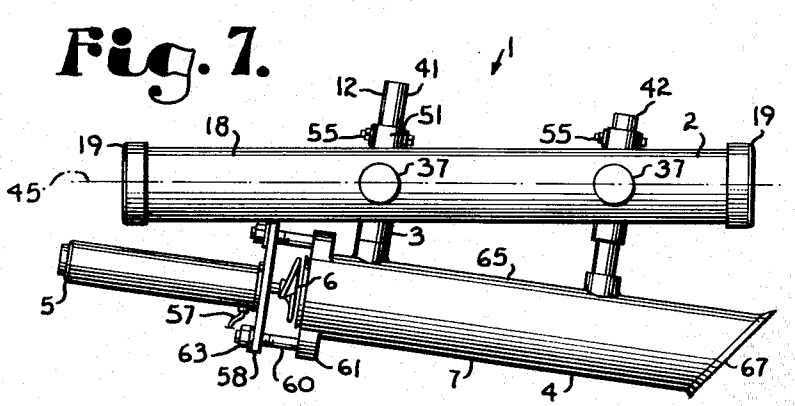
FIG. 7 is a side elevational view of the mixer showing adjustment into a downwardly tilted relationship.

In use, the aspirating horizontal mixer 1 is lifted, such as by two men, placed in a body of liquid, such as a sludge tank, aeration lagoon, or fish pond and suitably tethered or anchored in place. The depth of the nozzle member 7 is suitably adjusted by means of the lock means 51, thereby keeping the floats 17 and 18 the mixer unit 4 parallel and raising or lowering the mixer unit 4 relative thereto. If upward flow is desired, the mixer 1 is set to the position shown in FIG. 6, and for a downward flow, set in the position shown in FIG. 7. Thereafter, electrical power is supplied to the motor 5 to cause high speed rotation of the propeller 6 which sucks water about the motor mount 58 and posts 59 and 60 and forcibly drives the water through the nozzle member 7 with internal venturi means 8. As the water courses through the venturi means 8 and outwardly through the tubular member 72, the force of the water tends to draw air or other gas downwardly through the air delivery conduit 12, manifold means 13 and ports 14 and into the liquid flow stream whereupon the bubbles 78 mix with the liquid to aerate same and encourage biodegration within a sewage or sludge lagoon or tank and provide oxygenated water suitable for fish farming operations.

It is to be understood that while certain forms of the present invention have been illustrated and described herein, it is not to be limited to the specific forms or arrangement of parts described and shown.

What is claimed and desired to secure by Letters Patent is as follows:

1. An aeration and liquid mixing apparatus comprising:

(a) flotation means;

(b) a selectively tiltable support means adjustably connected to said flotation means and having a lower end extending downwardly therefrom for positioning at various selected heights;

(c) an air delivery conduit;

(d) a mixer unit mounted to said lower end, supported by said support means, and selectively adjustable in height and tilt therewith; said mixer unit including a submersible motor powering a propeller and a nozzle member situated in the flow path of liquid from said propeller;

(e) said nozzle member having wall means with an internal surface extending longitudinally therethrough and venturi means for mixing air from said air delivery conduit with liquid flowing therethrough;

(f) said venturi means including a converging wall formation forming a constriction; and (g) means forming an air injection port positioned adjacent said constriction for mixing air with said liquid.

2. The apparatus set forth in claim 1 including:

(a) a diverging wall formation leading downstream from said constriction and merging with said wall means internal surface; and (b) said air injection port extends through said diverging wall formation.

3. An aeration and liquid mixing apparatus comprising:

(a) flotation means of spaced, parallel floats of cylindrical configuration;

(b) spaced, parallel connector tubes extending through and between said floats and rotatable therein;

(c) a mixer unit including a submersible motor powering a propeller and a nozzle member situated in the flow path of liquid from said propeller;

(d) said nozzle member having wall means with an internal surface extending longitudinally therethrough and venturi means for mixing air with liquid flowing through said nozzle member, said venturi means including a converging wall formation forming a constriction;

(e) an air injection port positioned adjacent said constriction for mixing air with said liquid; and (f) spaced, parallel support tubes connected to and extending upwardly from said mixer unit and through said connector tubes and suspending said mixer unit generally between and below said floats and oriented longitudinally thereto;

(g) said support tubes being selectively slidable through said connector tubes for varying the depth of said mixer unit and differentially slidable through said connector tubes, with said connector tubes rotating in said floats, for tilting said mixer unit and directing said flow path of liquid.

4. An aeration and liquid mixing apparatus comprising:

(a) flotation means of spaced, parallel floats of cylindrical configuration;

(b) spaced, parallel connector tubes extending through and between said floats and rotatable therein;

(c) a mixer unit including a submersible motor powering a propeller and a nozzle member situated in the flow path of liquid from said propeller;

(d) said nozzle member having wall means with an internal surface extending longitudinally therethrough and venturi means for mixing air with liquid flowing through said nozzle member, said venturi means including a converging wall formation forming a constriction;

(e) an air injection port positioned adjacent said constriction for mixing air with said liquid;

(f) spaced, parallel support tubes connected to and extending upwardly from said mixer unit and through said connector tubes and suspending said mixer unit generally between and below said floats and oriented longitudinally thereto;

(g) said support tubes being selectively slidable through said connector tubes for varying the depth of said mixer unit and differentially slidable through said connector tubes, with said connector tubes rotating in said floats, for tilting said mixer unit and directing said flow path of liquid; and (h) one of said support tubes communicating with said port and being an air delivery tube.

5. An aeration and liquid mixing apparatus for a body of liquid comprising:

(a) spaced, parallel floats of cylindrical configuration having interior areas filled with foam material for flotation;

(b) spaced, parallel connector tubes extending through and between said floats and rotatable therein;

(c) upright first and second cross tubes affixed to and crossing respective said connector tubes, extending above and below same, and variable in tilt with rotation of said connector tubes;

(d) first and second support tubes respectively telescopically received in said first and second cross tubes;

(e) lock means respectively affixing said support tubes to said cross tubes for selectively varying the relative extension and retraction of said support tubes;

(f) said first support tube having a passage extending longitudinally therethrough and comprising an air delivery tube;

(g) a mixer unit suspended generally below and between said floats and including a submersible motor powering a propeller and having an elongate nozzle member situated in the flow path of liquid from said propeller;

(h) said nozzle member being of substantially cylindrical shape and having an inlet end situated adjacent said propeller and an outlet end spaced therefrom and with said first and second support tubes respectively connected to said nozzle member adjacent said inlet and outlet ends and thereby supporting said mixer unit;

(i) said nozzle member having wall means with an internal surface extending longitudinally therethrough and venturi means mixing air from said air delivery tube with liquid flowing therethrough;

(j) said venturi means including a converging wall formation forming a constriction situated adjacent said inlet end and a diverging wall formation leading downstream therefrom and merging with said wall means internal surface, said wall formations having portions spaced from said internal surface and providing an air delivery manifold around said constriction, said air delivery tube being in air flow communication therewith;

(k) a tubular member commencing at and extending downstream from said constriction and terminating in spaced relationship to said diverging wall formation so as to form a low pressure area thereat; and (l) a plurality of air injection ports extending through said diverging wall formation in said low pressure area and communicating with said manifold whereby flow of liquid through said venturi means draws air through said delivery tube and said ports for mixing with said liquid.

* * * * *